US010245475B2

(12) United States Patent
Aoki et al.

(10) Patent No.: US 10,245,475 B2
(45) Date of Patent: Apr. 2, 2019

(54) GOLF CLUB HEAD AND GOLF CLUB

(71) Applicant: MIZUNO CORPORATION, Osaka-shi, Osaka (JP)

(72) Inventors: Tomoaki Aoki, Osaka (JP); Daisuke Hosooka, Osaka (JP); Kazuhiro Doi, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 15/652,969

(22) Filed: Jul. 18, 2017

(65) Prior Publication Data

US 2019/0022474 A1 Jan. 24, 2019

(51) Int. Cl.
*A63B 53/04* (2015.01)

(52) U.S. Cl.
CPC ..... *A63B 53/04* (2013.01); *A63B 53/047* (2013.01); *A63B 53/0466* (2013.01); *A63B 53/0475* (2013.01); *A63B 2053/0408* (2013.01); *A63B 2053/0433* (2013.01); *A63B 2053/0462* (2013.01)

(58) Field of Classification Search
CPC ..... A63B 53/047
See application file for complete search history.

(56) References Cited

U.S. PATENT DOCUMENTS

2001/0051548 A1* 12/2001 Iwata ..... A63B 53/04 473/329
2012/0184394 A1* 7/2012 Boyd ..... A63B 53/0466 473/342

FOREIGN PATENT DOCUMENTS

JP 2006-175135 A 7/2006
JP 2006175135 * 7/2006 ..... A63B 53/04

* cited by examiner

*Primary Examiner* — Michael D Dennis
(74) *Attorney, Agent, or Firm* — Troutman Sanders LLP; Daniel Sharpe

(57) ABSTRACT

A golf club head according to an embodiment includes a face having a ball striking surface and a back surface. The back surface of the face has a thick portion located at a generally center portion thereof in a direction from the toe toward the heel, a thin portion located around the thick portion, and a tapered portion located between the thick portion and the thin portion. The thick portion has a first width which is a width in a heel-toe direction, and a second width which is a width in a sole-top direction and is larger than the first width, and the thick portion also has a first thickness. The thin portion has a second thickness smaller than the first thickness. The tapered portion has a thickness reduced from the side of the thick portion toward the side of the thin portion.

5 Claims, 7 Drawing Sheets

GOLF CLUB HEAD AND GOLF CLUB

This nonprovisional application is based on Japanese Patent Application No. 2016-070439 filed on Mar. 31, 2016, with the Japan Patent Office, the entire contents of which are hereby incorporated by reference.

BACKGROUND OF THE INVENTION

Field of the Invention

The present invention relates to a golf club head and a golf club.

Description of the Background Art

Conventionally, in order to allow a golf club to coestablish striking performance and durability, a structure of a face is known in which a face portion is partially varied in thickness.

Japanese Patent Laying-Open No. 2006-175135 describes a golf club having a face portion with a back surface having a thin portion and a thick portion. The thick portion is provided near the center of the face portion. A width of the thick portion in a direction from the heel side toward the toe side is narrower than a width thereof in a direction from the top side toward the sole side.

SUMMARY OF THE INVENTION

The golf club described in Japanese Patent Laying-Open No. 2006-175135 can improve a center portion of a face in rigidity while reducing a difference between a flying distance in a case of an off-center shot and a flying distance in a case of striking a ball at a sweet spot (i.e., a difference between a COR of the toe side or heel side of the face portion and a COR of the sweet spot).

The golf club described in Japanese Patent Laying-Open No. 2006-175135, however, has the face portion abruptly varying in shape at a boundary between the thin portion and the thick portion. Accordingly, the golf club described in Japanese Patent Laying-Open No. 2006-175135 will have stress concentration at the boundary between the thin portion and the thick portion. As a result, the golf club described in Japanese Patent Laying-Open No. 2006-175135 may have the boundary between the thin portion and the thick portion damaged when striking a ball. Furthermore, the golf club described in Japanese Patent Laying-Open No. 2006-175135 is required to have the thick portion to have a thickness of some extent to improve durability. As a result, the golf club described in Japanese Patent Laying-Open No. 2006-175135 would have a head having an increased overall weight.

The present invention has been made in view of such a problem in conventional art. That is, the present invention contemplates a golf club head and golf club which can reduce a difference between a flying distance in a case of an off-center shot and a flying distance in a case of striking a ball at a sweet spot while maintaining high repulsion performance at the sweet spot and can also maintain durability while minimizing an increase in weight.

A golf club head according to the present invention includes a face having a ball striking surface and a back surface opposite to the ball striking surface. The back surface of the face has a thick portion located at a generally center portion thereof in a direction from the toe of the golf club head toward the heel of the golf club head, a thin portion located around the thick portion, and a tapered portion located between the thick portion and the thin portion. The thick portion has a first width which is a width in a direction from the heel of the golf club head toward the toe of the golf club head, and a second width which is a width in a direction from the sole of the golf club head toward the top of the golf club head and larger than the first width, and the thick portion also has a first thickness. The thin portion has a second thickness smaller than the first thickness. The tapered portion has a thickness reduced from the side of the thick portion toward the side of the thin portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Hereafter, embodiments will be described with reference to the drawings. In the figures, identical or corresponding components are identically denoted. Furthermore, the embodiments described below may at least partially be combined together, as desired.

First Embodiment

Hereinafter, a configuration of a golf club head and golf club according to a first embodiment will be described.

A golf club head 1 according to the first embodiment is an iron golf club head.

Figure 1A:
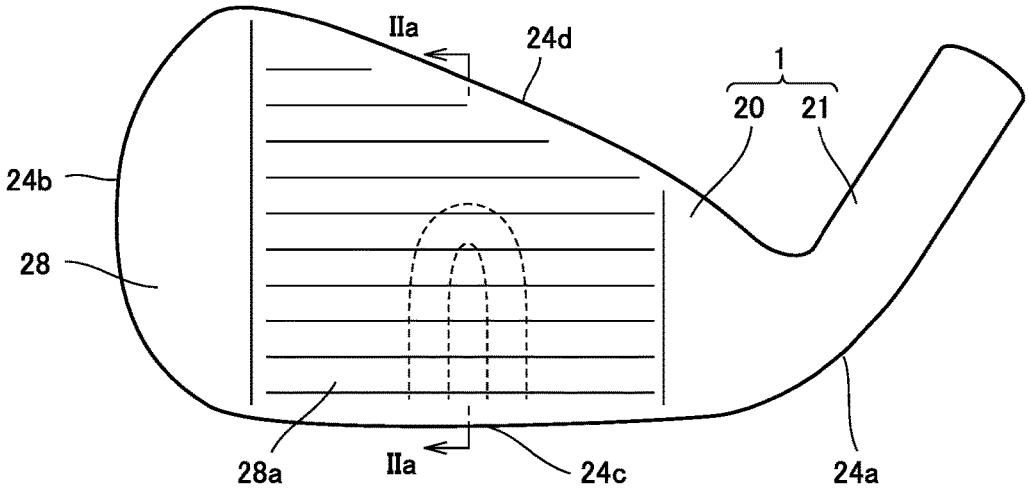
FIG. 1A is a front view of a golf club head according to a first embodiment.
Figure 1B:
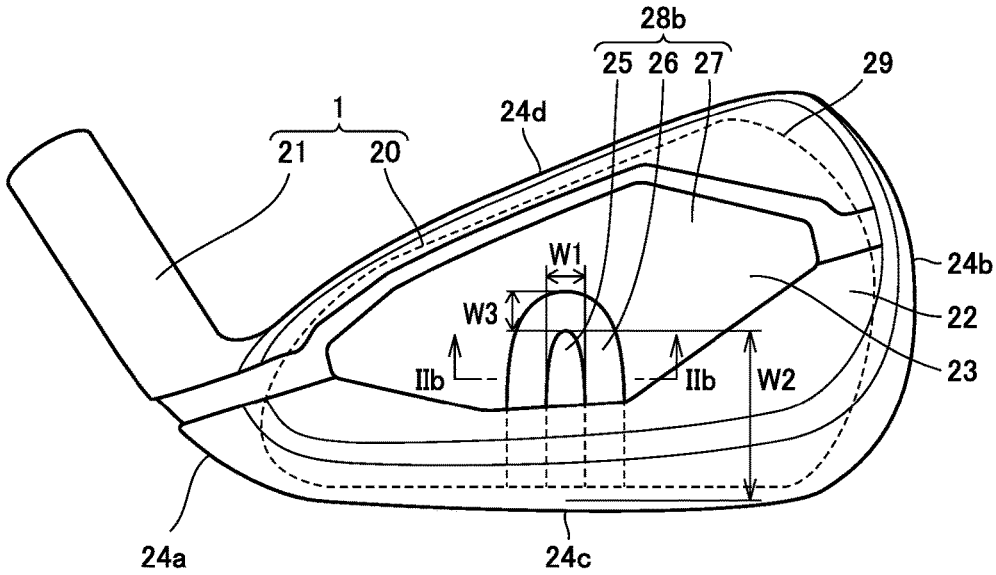
FIG. 1B is a rear view of the golf club head according to the first embodiment.

Golf club head 1 is, for example, a cavity back type iron head. FIG. 1A is a front view of golf club head 1 according to the first embodiment. FIG. 1B is a rear view of golf club head 1 according to the first embodiment. Golf club head 1 according to the first embodiment is formed for example by casting.

With reference to FIGS. 1A and 1B, and 2A and 2B, golf club head 1 includes a hosel 21 receiving a shaft therethrough, and a head body 20. Head body 20 has a face portion 28, a heel portion 24*a*, a toe portion 24*b*, a sole portion 24*c*, and a top edge portion 24*d*.

Heel portion 24*a* is a portion connecting a lower end of hosel 21 and sole portion 24*c* together. Toe portion 24*b* is a portion connecting sole portion 24*c* and top edge portion 24*d* at a position opposite to heel portion 24*a*. Sole portion 24*c* is a portion constituting a bottom portion of golf club head 1. Top edge portion 24*d* is a portion constituting an upper edge portion of head body 20.

Face portion 28 is further composed of a face surface 28*a* and a back face surface 28*b*. Face surface 28*a* forms a ball striking surface. Back face surface 28*b* is a surface opposite to face surface 28*a*.

On the back side of head body 20, an edge portion 22 is formed. Edge portion 22 surrounds a periphery of the back surface side of head body 20. Edge portion 22 defines a cavity 23. As a result, the back side of head body 20 has a shape concaved toward the ball striking surface.

Edge portion 22 is provided with an undercut 29. Undercut 29 is in the form of a groove along back face surface 28*b*. Undercut 29 is provided in each of heel portion 24*a*, toe portion 24*b*, sole portion 24*c*, and top edge portion 24*d*.

Figure 2A:
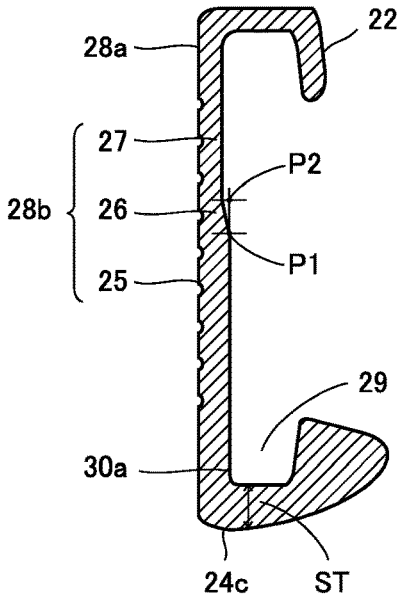
FIG. 2A is a cross-sectional view of the golf club head according to the first embodiment taken along a line IIa-IIa.

FIG. 2A is a cross-sectional view taken along a line IIa-IIa in FIG. 1A, and is a cross-sectional view of head body 20 cut at a score line center perpendicularly to a score line (hereinafter referred to as a "reference cross section").

Undercut 29 for example has a width of 6.0 mm or more and 8.5 mm or less on the side of sole portion 24*c* for a number six iron. The thinnest portion of sole portion 24*c*, that is, a distance ST between a bottom surface of undercut 29 and a sole surface of sole portion 24*c* (i.e., a surface of sole portion 24*c* opposite to a side provided with undercut 29) is preferably 1.5 mm or more and 2.0 mm or less, taking into consideration high repulsion improved by deflection of sole portion 24*c* and the durability of sole portion 24*c*.

As shown in FIGS. 1A and 2A, back face surface 28*b* has a thick portion 25, a tapered portion 26, and a thin portion 27. Thick portion 25, in a toe-heel direction (a direction from toe portion 24*b* toward heel portion 24*a*), is located around a center of face portion 28. Specifically, as shown in FIG. 1A, thick portion 25 is provided such that a center thereof in the toe-heel direction is at a position passing through the score line center. Furthermore, in a top-sole direction (a direction from top edge portion 24*d* toward sole portion 24*c*), as shown in FIGS. 1B and 2A, thick portion 25 is provided in contact with sole portion 24*c*.

Figure 2B:
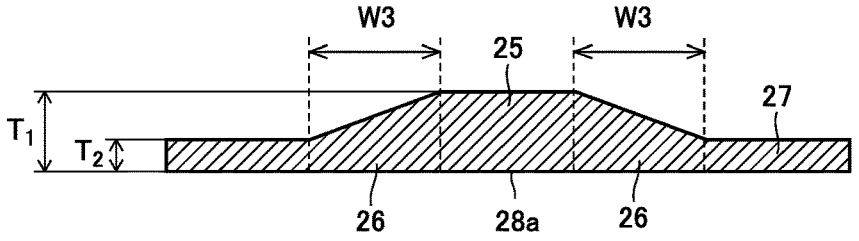
FIG. 2B is a cross-sectional view of the golf club head according to the first embodiment taken along a line IIb-IIb.
Figure 2C:
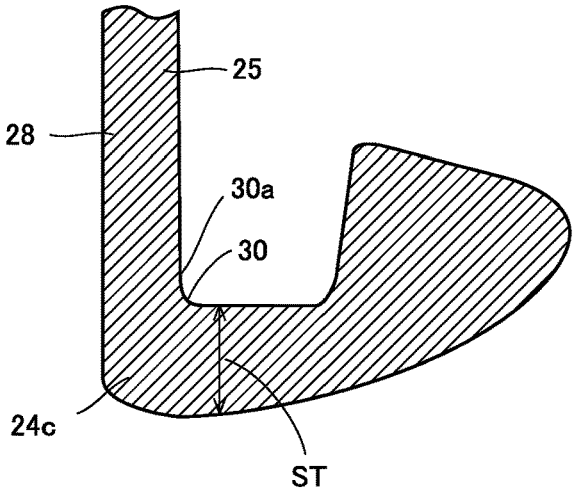
FIG. 2C is an enlarged view of a vicinity of a sole portion in FIG. 2A.

FIG. 2C is an enlarged view of a vicinity of sole portion 24*c* in FIG. 2A. As shown in FIG. 2C, thick portion 25 is connected to sole portion 24*c* via a fillet portion 30 connecting a wall surface of undercut 29 on the side of the sole and back face surface 28*b*. Thick portion 25 has a lower end matching an end 30*a* of fillet portion 30 closer to the face.

On back face surface 28*b*, thin portion 27 is located around thick portion 25. Tapered portion 26 is located between thick portion 25 and thin portion 27.

Referring to FIG. 1B, thick portion 25 has a first width W1 and a second width W2. First width W1 is a maximum value of a width of thick portion 25 in a direction from the heel portion 24*a* side toward the toe portion 24*b* side. Second width W2 is a maximum value of a width of thick portion 25 in a direction from the sole portion 24*c* side toward the top edge portion 24*d* side. First width W1 is narrower than second width W2.

More specifically, with reference to the reference cross section (see FIG. 2A), second width W2 is a distance between end 30*a* closer to the face and an intersection point P1 at which a line segment perpendicular to face surface 28*a* passing through an end point of thick portion 25 closer to top edge portion 24*d* and a line segment extending from end 30*a* closer to the face parallel to face surface 28*a* intersect each other.

Tapered portion 26 has a third width W3. Third width W3 is a distance of a line segment perpendicular to line tangent to a contour of thick portion 25 appearing in the rear view of FIG. 1B, that is sandwiched between a contour of tapered portion 26 and a contour of thick portion 25. Preferably, third width W3 is 2 mm or more 20 mm or less.

Third width W3 may be uniform as long as it has a value within the above range and a maximum value of a total length of thick portion 25 and tapered portion 26 when golf club head 1 set on a horizontal plane such that golf club head 1 has loft and lie angles as set (hereinafter referred to as a "reference position") is cut in the toe-heel direction horizontally is shorter than a maximum value of a total length of thick portion 25 and tapered portion 26 when golf club head 1 in the reference position is cut in the top-sole direction vertically. Third width W3 may be a non-uniform width such that it is increased from the top edge portion 24*d* side toward the sole portion 24*c* side. Note that golf club head 1 according to the first embodiment has tapered portion 26 having third width W3 which is a uniform width.

FIG. 2B is a cross-sectional view of golf club head 1 according to the first embodiment taken along a line IIb-IIb shown in FIG. 1B. Thick portion 25 is thicker than thin portion 27 on back face surface 28*b*. Thick portion 25 has a first thickness T1. Thin portion 27 has a second thickness T2. First thickness T1 is thicker than second thickness T2. First thickness T1 and second thickness T2 have a difference of 0.25 mm or more and 1.50 mm or less, preferably 0.25 mm or more and 1.25 mm or less. Thin portion 27 has a thickness for example of 1.8 mm or more and 3.0 mm or less.

Tapered portion 26 is thicker than thin portion 27 and thinner than thick portion 25 on the back face surface 28*b*. Specifically, tapered portion 26 has a thickness matching first thickness T1 on the thick portion 25 side and matching second thickness T2 on the thin portion 27 side, and decreasing as it is away from the thick portion 25 side and approaches the thin portion 27 side.

For example, tapered portion 26 is linearly reduced in thickness as it is away from the thick portion 25 side and approaches the thin portion 27 side. Note, however, that the thickness of tapered portion 26 is not limited as such. It suffices that tapered portion 26 has a thickness reduced as it is away from the thick portion 25 side and approaches the thin portion 27 side.

Hereinafter, an effect of golf club head 1 according to the first embodiment will be described, as compared with a comparative example.

Figure 3:
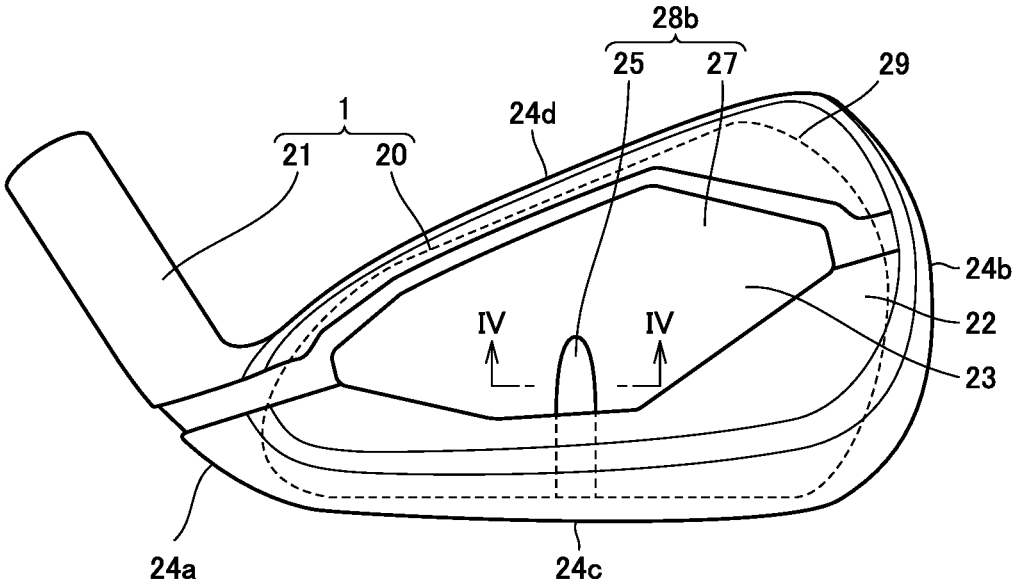
FIG. 3 is a rear view of a golf club head according to a comparative example.
Figure 4:
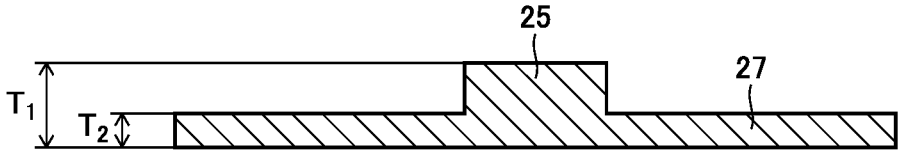
FIG. 4 is a cross sectional view of the golf club head according to the comparative example taken along a line IV-IV.

FIG. 3 is a rear view of a golf club head according to the comparative example. FIG. 4 is a cross sectional view of the golf club head according to the comparative example taken along a line IV-IV shown in FIG. 3.

As shown in FIGS. 3 and 4, the golf club head according to the comparative example is different from golf club head 1 according to the first embodiment in that the former does not have tapered portion 26.

Golf club head 1 according to the first embodiment with first thickness T1 and second thickness T2 having a difference of 0.5 mm had face portion 28 subjected to measuring a maximum value of a VM stress (Von Mises stress), which indicated 1700 MPa.

Note that VM stress is a value used as a fracture criterion for material. VM stress is calculated by $\{(\sigma1-\sigma2)^2+(\sigma2-\sigma3)^2+(\sigma3-\sigma1)^2\}^{1/2}$, where σ1, σ2, σ3 represent major stresses in mutually orthogonal three directions.

The golf club head according to the comparative example with first thickness T1 and second thickness T2 having a difference of 4 mm had face portion 28 subjected to measuring a maximum value of a VM stress, which indicated 1924 MPa.

As has been set forth above, golf club head 1 according to the first embodiment has tapered portion 26 between thick portion 25 and thin portion 27. Accordingly, the golf club according to the first embodiment has thick portion 25 and thin portion 27 with their respective surfaces connected via a continuous variation in thickness. Accordingly, a golf club according to the first embodiment, as compared with a golf club according to the comparative example, alleviates stress concentration at a portion connecting thick portion 25 and thin portion 27. As a result, the golf club according to the first embodiment is enhanced in durability despite the small difference between T1 and T2.

Further, the golf club according to the first embodiment that can have face portion 28 provided with tapered portion 26, as described above, to enhance durability allows thick portion 25 to have a reduced thickness. This allows the head to be lighter in weight than the comparative example having face portion 28 composed only of thick portion 25 and thin portion 27.

Hereinafter, an effect of setting a difference between first thickness T1 and second thickness T2 in the first embodiment to 0.25 mm or more and 1.25 mm or less will be described.

Figure 5:
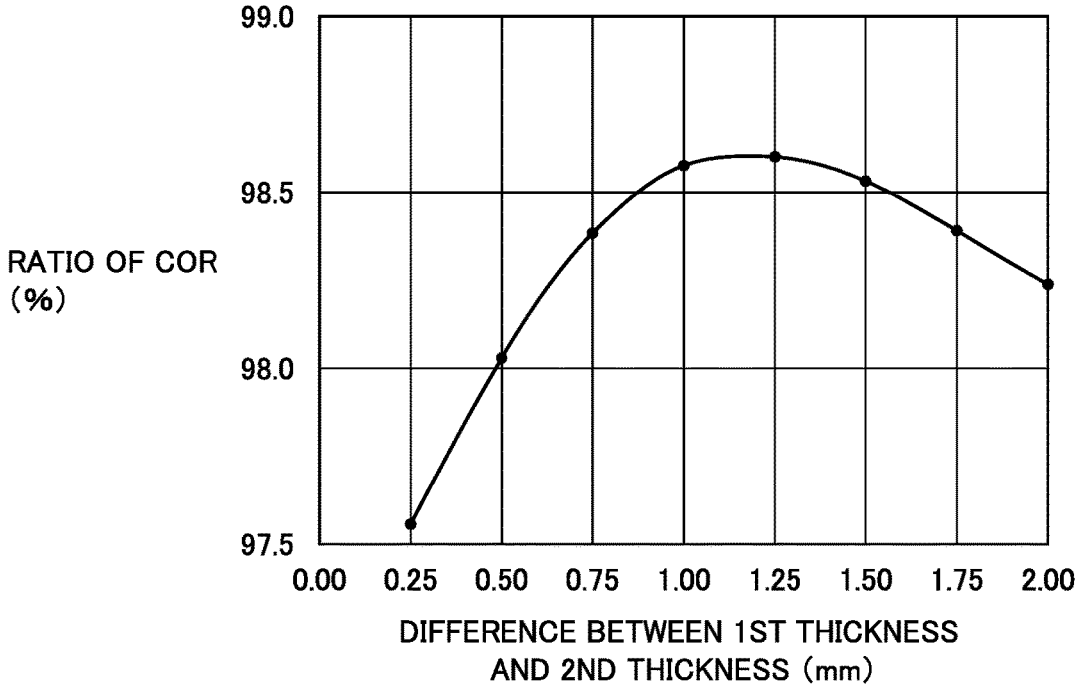
FIG. 5 represents an effect of a difference between a first thickness and a second thickness on a COR of a face portion on a heel side and a toe side.

FIG. 5 represents an effect of a difference between first thickness T1 and second thickness T2 on a COR of face portion 28 on the heel portion 24*a* side and the toe portion 24*b* side. In FIG. 5, the axis of abscissa represents the difference between first thickness T1 and second thickness T2. In FIG. 5, the axis of ordinate represents a ratio of a COR of face portion 28 at a sweet spot and an average value of a COR of face portion 28 on the heel portion 24*a* side and a COR of face portion 28 on the toe portion 24*b* side.

As shown in FIG. 5, as the difference between first thickness T1 and second thickness T2 increases, a ratio of the average value of the COR of face portion 28 on the heel portion 24*a* side and the COR of face portion 28 on the toe portion 24*b* side to the COR of face portion 28 at the sweet spot increases. In other words, as the difference between first thickness T1 and second thickness T2 increases, a difference between a flying distance in a case of an off-center shot and a flying distance in a case of striking a ball at the sweet spot decreases.

In contrast, when the difference between first thickness T1 and second thickness T2 is 25 mm or more, the ratio of the average value of the COR of face portion 28 on the heel portion 24*a* side and the COR of face portion 28 on the toe portion 24*b* side to the COR of face portion 28 at the sweet spot starts to decrease. That is, as the difference between first thickness T1 and second thickness T2 is increased to 1.25 mm or more, the difference between the flying distance in the case of the off-center shot and the flying distance in the case of striking a ball at the sweet spot would be increased.

Figure 6:
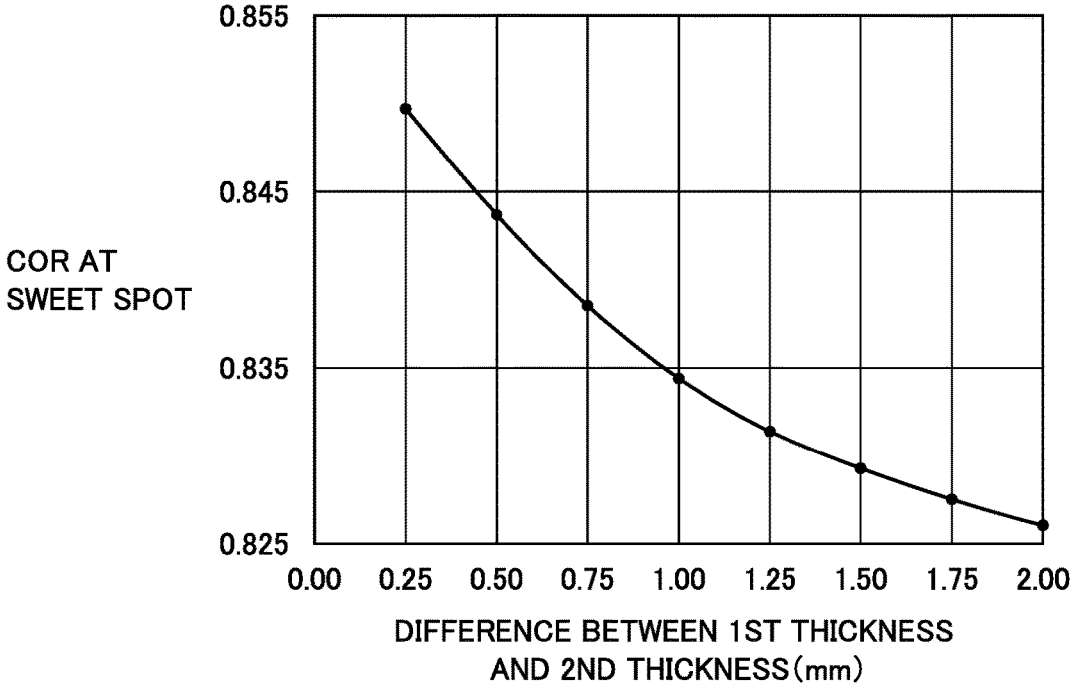
FIG. 6 represents an effect of the difference between the first thickness and the second thickness on a COR of the face portion at a sweet spot.

FIG. 6 represents an effect of the difference between first thickness T1 and second thickness T2 on the COR of face portion 28 at a sweet spot. In FIG. 6, the axis of abscissa represents the difference between first thickness T1 and second thickness T2. In FIG. 6, the axis of ordinate represents the COR of face portion 28 at the sweet spot.

As shown in FIG. 6, as the difference between first thickness T1 and second thickness T2 increases, the COR of face portion 28 at the sweet spot decreases. That is, if the difference between first thickness T1 and second thickness T2 is excessively increased, the flying distance in the case of striking a ball at the sweet spot would decrease.

Thus, when the difference between first thickness T1 and second thickness T2 is 0.25 mm or more and 1.25 mm or less, a difference between a flying distance in a case of striking a ball at a sweet spot and a flying distance in a case of an off-center shot can be suppressed and a decrease in the flying distance in the case of striking a ball at the sweet spot can also be suppressed.

Hereinafter, an effect obtained in the first embodiment by setting third width W3 to 2 mm or more and 20 mm or less will be described.

Figure 7:
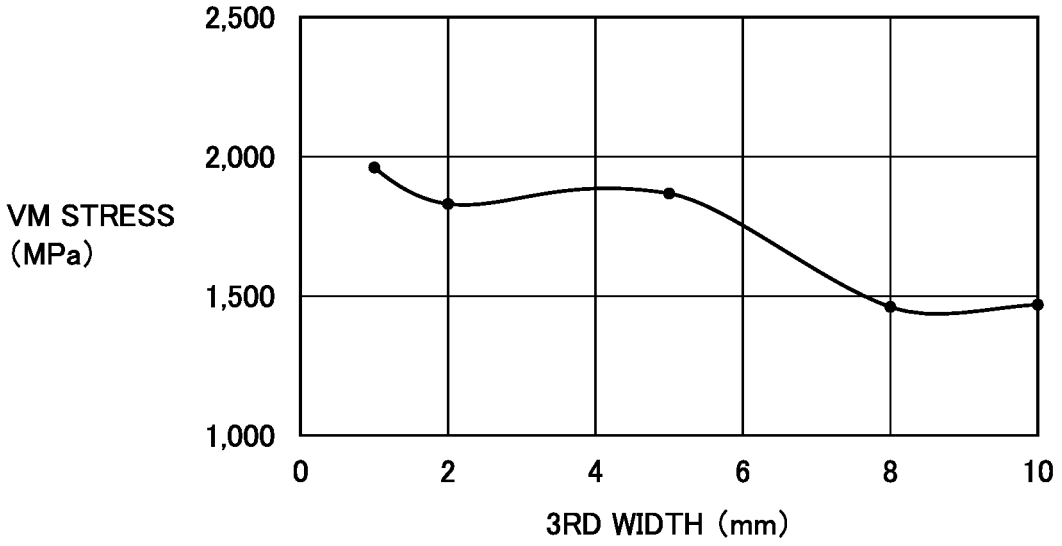
FIG. 7 represents a relationship between a third width and a maximum value of a VM stress at the face portion.

FIG. 7 represents a relationship between third width W3 and a maximum value of a VM stress in face portion 28. In FIG. 7, the axis of abscissa represents third width W3. In FIG. 7, the axis of ordinate represents a maximum value of a VM stress in face portion 28.

As shown in FIG. 7, as third width W3 increases, the maximum value of the VM stress in face portion 28 decreases. Specifically, when third width W3 is 1 mm, the maximum value of the VM stress in face portion 28 is 1967.8 MPa, and when third width W3 is 2 mm, the maximum value of the VM stress in face portion 28 is 1839.1 MPa.

When golf club head 1 is formed using stainless steel, which is a material normally used for a golf club head, and third width W3 is less than 2 mm, the maximum value of the VM stress would exceed a value tolerable by the material of golf club head 1. In contrast, when third width W3 is 2 mm or more, the maximum value of the VM stress is within a range tolerable by the material of golf club head 1. Thus, it is preferable that third width W3 be 2 mm or more.

Golf club head 1 has sole portion 24*c* and top edge portion 24*d* with a distance normally of about 40 mm therebetween. Accordingly, it is difficult to set third width W3 to 20 mm or more. Thus, it is preferable that third width W3 be 20 mm or less.

From the above, by setting third width W3 to 2 mm or more and 20 mm or less, the maximum value of the VM stress caused in face portion 28 can fall within a range tolerable by a material used to produce golf club head 1.

Hereinafter, an effect of providing thick portion 25 in contact with sole portion 24*c* will be described.

Enhancing golf club head 1 in durability requires improving face portion 28 in durability as well as improving sole portion 24*c* in durability. By providing a thickness, that is, fillet portion 30, to a boundary portion between face portion 28 and sole portion 24*c*, a VM stress in sole portion 24*c* on the side of the sole surface can be reduced. Accordingly, by extending thick portion 25 from sole portion 24*c* via fillet portion 30, sole portion 24*c* can be enhanced in durability.

In particular, when undercut 29 is provided, extending thick portion 25 from an upper surface of sole portion 24*c* located in undercut 29 allows sole portion 24*c* to have a reduced thickness. This can enhance sole portion 24*c* in durability while maintaining high repulsion attributed to undercut 29.

Furthermore, it is preferable that golf club head 1 according to the first embodiment satisfy a relationship of (first width W1+2×third width W3)/(taper's upper end level)≤0.5. In other words, it is preferable that a total width of thick portion 25 and tapered portion 26 in the direction from the sole portion 24*c* side toward the top edge portion 24*d* side be twice a total width of thick portion 25 and tapered portion 26 in the direction from the heel portion 24*a* side toward the toe portion 24*b* side or more.

The taper's upper end level is a length from sole portion 24*c* to a top portion of tapered portion 26. More specifically, with reference to the reference cross section (see FIG. 2A) the taper's upper end level is a distance between end 30*a* closer to the face and an intersection point P2 at which a line segment perpendicular to face surface 28*a* passing through an end point of tapered portion 26 closer to top edge portion 24*d* and a line segment extending from end 30*a* closer to the face parallel to face surface 28*a* intersect each other.

According to the findings obtained by the inventors, (first width W1+2×third width W3)/(taper's upper end level) has a value having a strong negative correlation with the ratio of the COR of face portion 28 at the sweet spot and the average value of the COR of face portion 28 on the heel portion 24*a* side and the COR of face portion 28 on the toe portion 24*b* side.

For example, when (first width W1+2×third width W3)/(taper's upper end level) had a value of 0.23, the ratio of the COR of face portion 28 at the sweet spot and the average value of the COR of face portion 28 on the heel portion 24*a* side and the COR of face portion 28 on the toe portion 24*b* side was 98.6%.

Accordingly, (first width W1+2×third width W3)/(taper's upper end level) having a value 0.5 or less can further reduce a difference between a flying distance in a case of an off-center shot and a flying distance in a case of striking a ball at the sweet spot.

Figure 10:
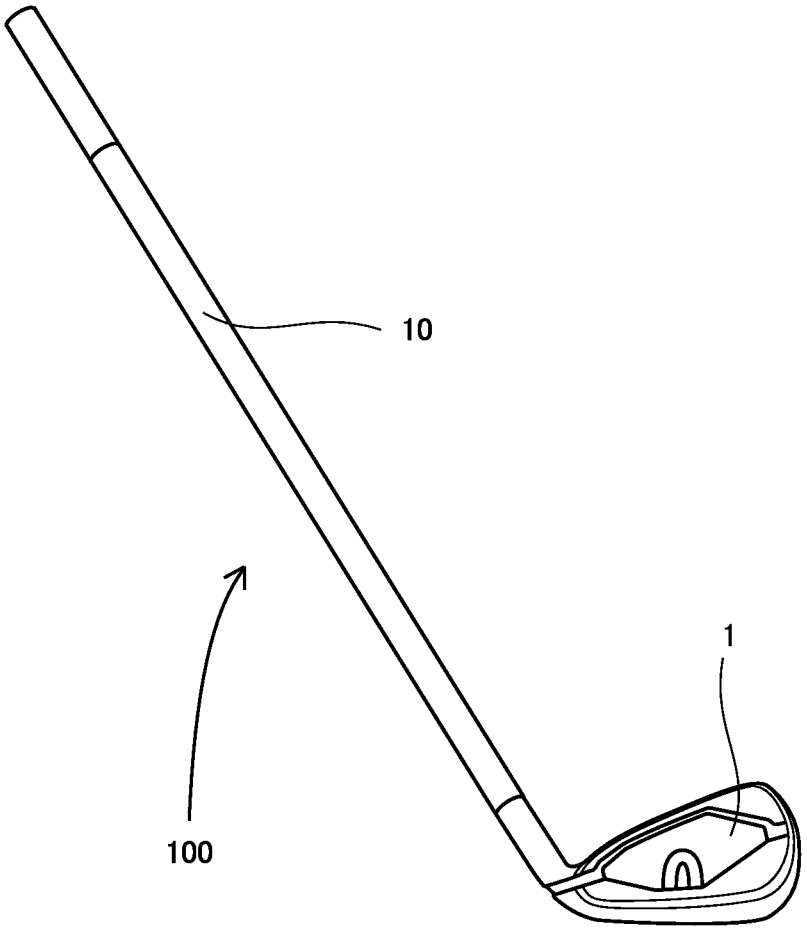
FIG. 10 shows a golf club according to the present invention.

A golf club 100 is obtained by fixing a shaft 10 to golf club head 1 configured as described above. FIG. 10 is an overall view of golf club 100 including golf club head 1 according to the first embodiment. Such golf club 100 can provide high repulsion and durability.

Second Embodiment

Hereinafter, a configuration of a golf club head 2 according to a second embodiment will be described. A difference from the first embodiment will mainly be described.

Figure 8:
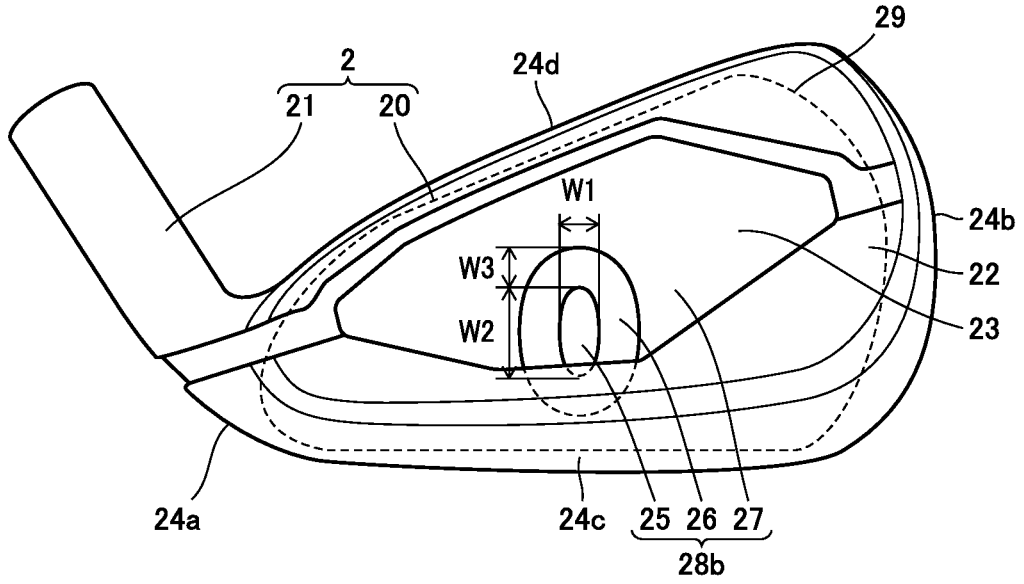
FIG. 8 is a rear view of a golf club head according to a second embodiment.

FIG. 8 is a rear view of golf club head 2 according to the second embodiment. As shown in FIG. 8, golf club head 2 according to the second embodiment is different from golf club head 1 according to the first embodiment in that face portion 28 has thick portion 25 out of contact with sole portion 24*c*.

it is preferable that golf club head 2 according to the second embodiment, as well as the first embodiment, also satisfy the relationship of (first width W1+2×third width W3)/(taper's upper end level)≤0.5. In other words, it is preferable that a total width of thick portion 25 and tapered portion 26 in the direction from the sole portion 24*c* side toward the top edge portion 24*d* side be twice a total width of thick portion 25 and tapered portion 26 in the direction from the heel portion 24*a* side toward the toe portion 24*b* side or more. The taper's upper end level is a distance from end 30*a* closer to the face to intersection point P2, similarly as has been described in the first embodiment.

In golf club head 2 according to the second embodiment, for example when (first width W1+2×third width W3)/(taper's upper end level) has a value of 2.09, the ratio of the COR of face portion 28 at the sweet spot and the average value of the COR of face portion 28 on the heel portion 24*a* side and the COR of face portion 28 on the toe portion 24*b* side was 98.1%.

When (first width W1+2×third width W3)/(taper's upper end level) has a value of 1.16, the ratio of the COR of face portion 28 at the sweet spot and the average value of the COR of face portion 28 on the heel portion 24*a* side and the COR of face portion 28 on the toe portion 24*b* side was 98.3%.

When (first width W1+2×third width W3)/(taper's upper end level) has a value of 0.87, the ratio of the COR of face portion 28 at the sweet spot and the average value of the COR of face portion 28 on the heel portion 24*a* side and the COR of face portion 28 on the toe portion 24*b* side was 98.4%.

When (first width W1+2×third width W3)/(taper's upper end level) has a value of 0.41, the ratio of the COR of face portion 28 at the sweet spot and the average value of the COR of face portion 28 on the heel portion 24*a* side and the COR of face portion 28 on the toe portion 24*b* side was 98.6%.

Thus, golf club head 2 according to the second embodiment with (first width W1+2×third width W3)/(taper's upper end level) having a value 0.5 or less can also further reduce a difference between a flying distance in a case of an off-center shot and a flying distance in a case of striking a ball at the sweet spot.

Third Embodiment

A configuration of a golf club head according to a third embodiment will be described. A difference from the other embodiments will mainly be described.

Figure 9A:
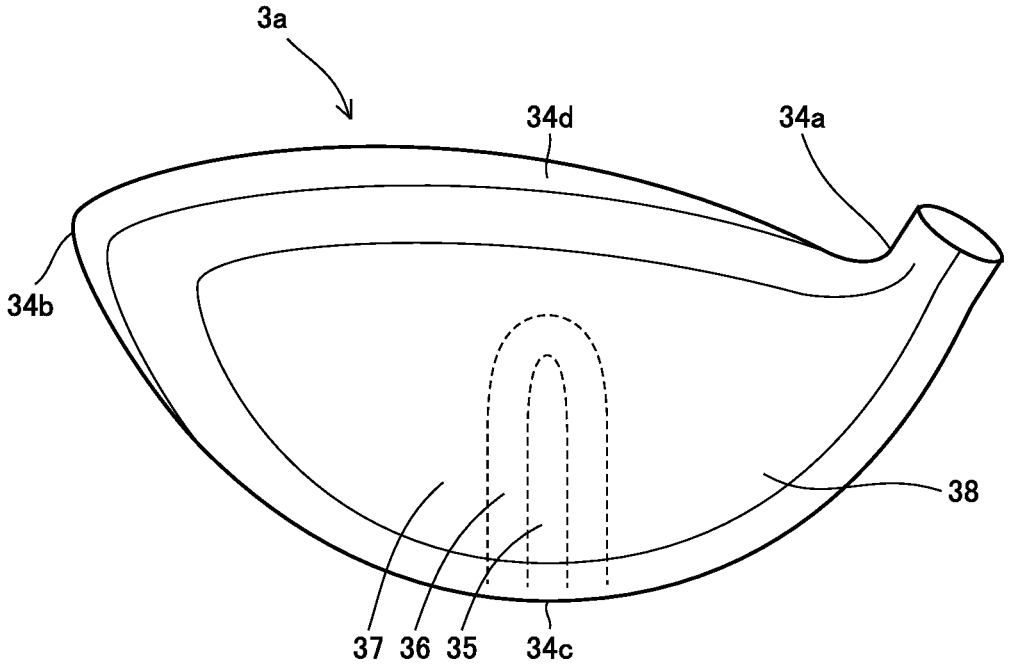
FIG. 9A is a rear view of one example of a golf club head according to a third embodiment.

The golf club head according to the third embodiment is a wood type head, for example. FIG. 9A is a rear view of a golf club head 3*a* according to the third embodiment.

Golf club head 3*a* has a face portion 38. Furthermore, golf club head 3*a* has a heel portion 34*a*, a toe portion 34*b*, a sole portion 34*c*, and a crown portion 34*d*. Face portion 38 has a back surface with a thick portion 35, a tapered portion 36, and a thin portion 37.

Figure 9B:
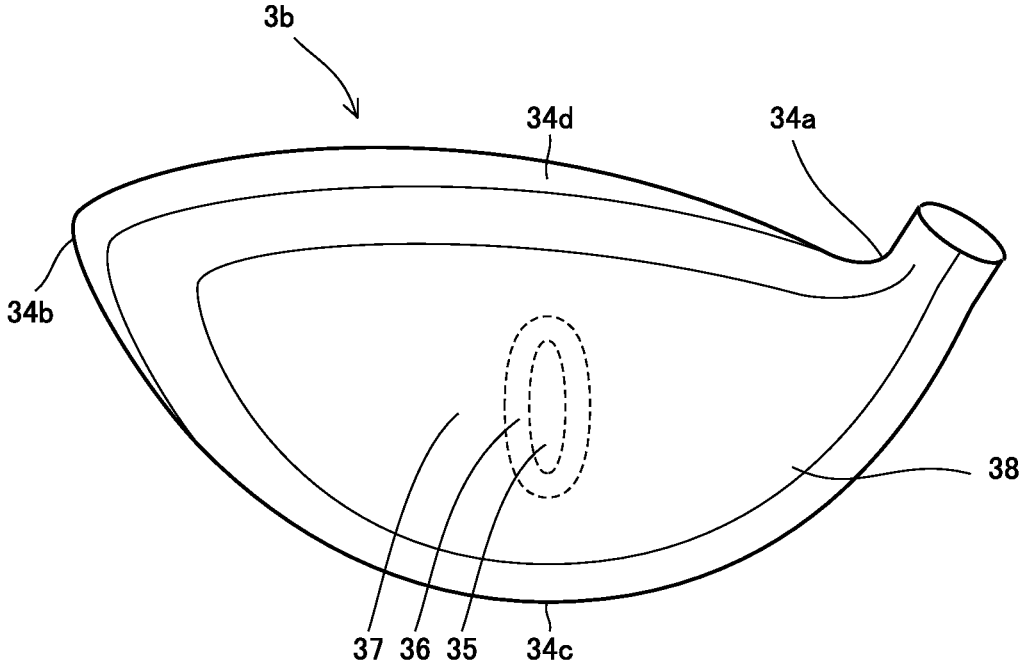
FIG. 9B is a front view of another example of the golf club head according to the third embodiment.

As shown in FIG. 9A, wood type golf club head 3*a* may also have thick portion 35 and tapered portion 36 extended from sole portion 34*c*. FIG. 9B is a front view of another example of the golf club head according to the third embodiment. As shown in FIG. 9B, a golf club head 3*b* according to the other example may have thick portion 35 and tapered portion 36 formed at the face only in a vicinity of the sweet spot.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. An iron golf club head comprising:

a face having a ball striking surface and a back surface opposite to the ball striking surface, a sole portion constituting a bottom portion of the iron golf club head, an edge portion provided at the back surface and defining a cavity, the edge portion having an undercut portion, the back surface of the face having a thick portion located at a generally center portion thereof in a direction from a toe of the golf club head toward a heel of the golf club head, a thin portion located around the thick portion, and a tapered portion located between the thick portion and the thin portion, the thick portion having a first width which is a width in a direction from the heel of the golf club head toward the toe of the golf club head, and a second width which is a width in a direction from the sole of the golf club head toward a top of the golf club head and larger than the first width, the thick portion also having a first thickness, wherein the thick portion extends from an upper surface the sole portion located in the undercut portion, wherein the thick portion is connected to the sole portion via a fillet portion, the thin portion having a second thickness smaller than the first thickness, wherein the second thickness of the thin portion is a constant thickness, the tapered portion having a thickness reduced from a side of the thick portion toward a side of the thin portion, and at least a part of the thick portion being located in the undercut portion.

2. The iron golf club head according to claim 1, wherein the first thickness and the second thickness have a difference of 0.25 mm or more and 1.25 mm or less.

3. The iron golf club head according to claim 1, wherein:

the tapered portion has a third width; and the third width is 2 mm or more and 20 mm or less.

4. The iron golf club head according to claim 1, wherein:

the tapered portion has a third width; and a value of the first width plus the third width multiplied by two, divided by a length from the sole to a top portion of the tapered portion, is 0.5 or less.

5. An iron golf club comprising the iron golf club head according to claim 1.

* * * * *